US010688815B2

(12) United States Patent
Mizutani

(10) Patent No.: US 10,688,815 B2
(45) Date of Patent: Jun. 23, 2020

(54) PRINTER INCLUDING A CUTTER HAVING MOVABLE BLADE

(71) Applicant: Brother Kogyo Kabushiki Kaisha, Nagoya-shi, Aichi-ken (JP)

(72) Inventor: Hiromitsu Mizutani, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/291,990

(22) Filed: Mar. 4, 2019

(65) Prior Publication Data

US 2019/0270322 A1 Sep. 5, 2019

(30) Foreign Application Priority Data

Mar. 5, 2018 (JP) ..... 2018-038829

(51) Int. Cl.
*B41J 11/66* (2006.01)
*B41J 3/407* (2006.01)
*B26D 1/08* (2006.01)

(52) U.S. Cl.
CPC ..... *B41J 11/663* (2013.01); *B26D 1/08* (2013.01); *B41J 3/4075* (2013.01)

(58) Field of Classification Search
CPC ..... B41J 11/663; B41J 3/4075; B26D 1/08; B26D 1/305; B26D 2001/0066; B26D 1/025
See application file for complete search history.

(56) References Cited

U.S. PATENT DOCUMENTS 8,907,997 B1 * 12/2014 Takahashi ..... B41J 11/703 347/218
2018/0093504 A1 * 4/2018 Kasai ..... B26D 1/085
2018/0257411 A1 * 9/2018 Kato ..... B41J 29/17

FOREIGN PATENT DOCUMENTS

JP 2005-053177 A 3/2005

* cited by examiner

*Primary Examiner* — Henok D Legesse
(74) *Attorney, Agent, or Firm* — Banner & Witcoff, Ltd.

(57) ABSTRACT

A printer may ensure continued sufficiency of cutting performance of a cutter for performing printing on a medium. The printer may include a casing having a space, the cutter disposed in the casing and configured to cut at least a portion of the medium, a moving mechanism configured to move the cutter, and a controller configured to control the moving mechanism to move the cutter to at least one stop position at which a portion of the cutter is positioned at the space.

15 Claims, 18 Drawing Sheets

PRINTER INCLUDING A CUTTER HAVING MOVABLE BLADE

CROSS-REFERENCE TO RELATED APPLICATION

This application claims priority from Japanese Patent Application No. 2018-038829 filed on Mar. 5, 2018, the content of which is incorporated herein by reference in its entirety.

FIELD OF DISCLOSURE

Aspects described herein relate to a printer.

BACKGROUND

Some known printers include a cutter for cutting a printed medium. For example, a known tape printer includes a cutting mechanism in its casing. The cutting mechanism is used for cutting a tape. The cutting mechanism includes a fixed blade and a movable blade. The movable blade moves relative to the fixed blade to cut the tape by their cutting edges that slide past each other. Under normal conditions, the movable blade is in an initial state in which the cutting edge of the movable blade is apart from the cutting edge of the fixed blade. The tape printer cuts the tape using the cutting mechanism and discharges the cut tape through a tape exit. The tape exit may be an opening defined in the casing.

SUMMARY

The movable blade may become dirty with foreign matter such as tape cuttings or waste, or dust. If the movable blade becomes dirty, a user may clean the movable blade. For example, the user may insert a swab into the casing through the tape exit to remove foreign matter from the movable blade. Nevertheless, the movable blade in the initial state may be located at a position invisible or hardly visible to the user through the tape exit, thereby causing the user to have difficulty in cleaning of the movable blade. This may thus cause degradation of cutting performance of the cutting mechanism.

Accordingly, some embodiments described herein provide for a printer that may ensure continued cutting performance of a cutter.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
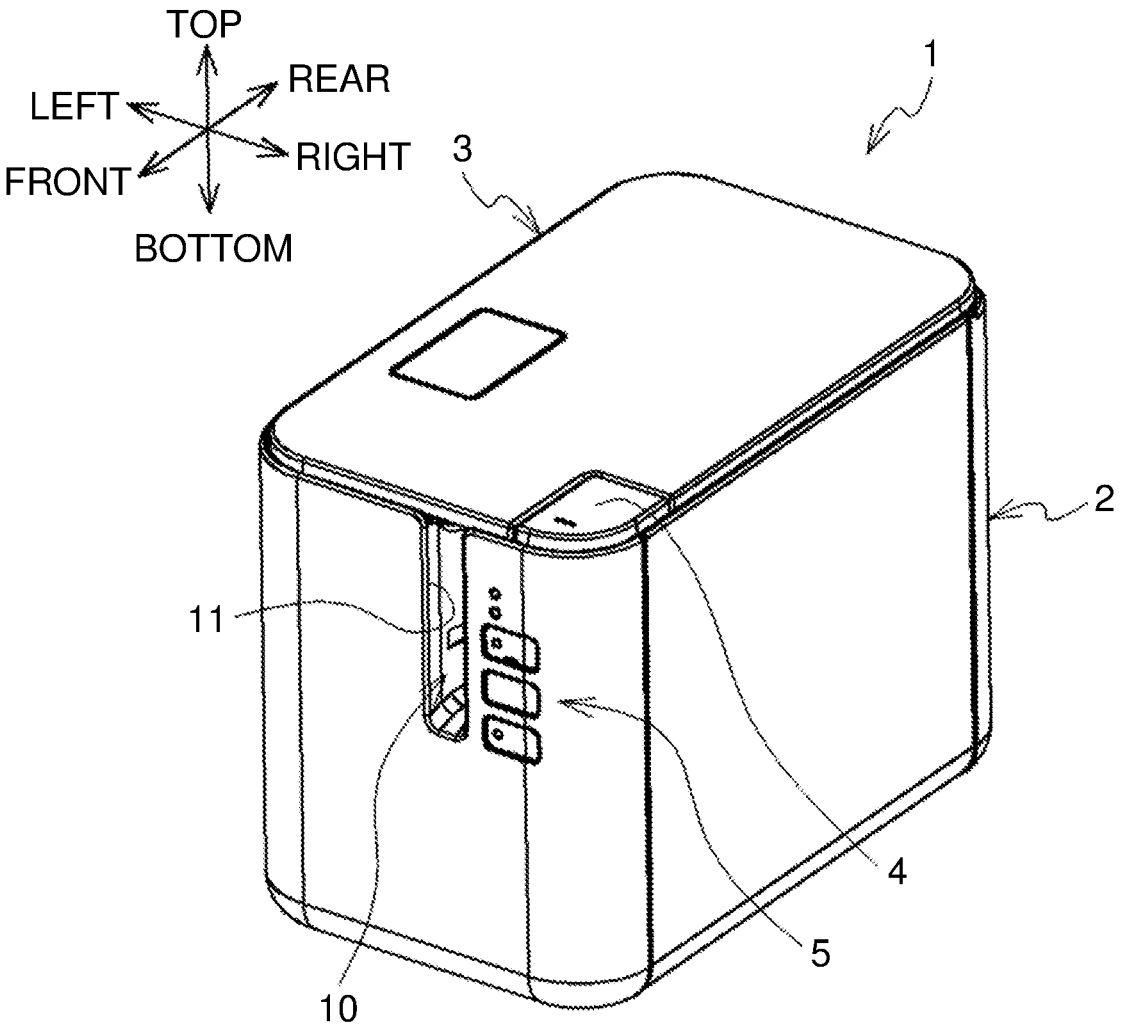
FIG. 1 is a right, top, front perspective view of a printer in an illustrative embodiment according to one or more aspects of the disclosure, wherein a cover of the printer is located at a closed position.

Hereinafter, illustrative embodiments will be described with reference to the accompanying drawings. The drawings illustrate merely examples for showing technical features that may be adopted for the disclosure. Configurations illustrated in the drawings are merely examples but not intended to limit the disclosure thereto.

Referring to FIGS. 1 to 4, a mechanical configuration of a printer 1 will be described. Hereinafter, directions, e.g., top, bottom, right, left, front and rear, indicated by arrows in each drawing may be defined as orientation of the printer 1 that may be disposed in which it may be intended to be used as depicted in FIG. 1.

Figure 2:
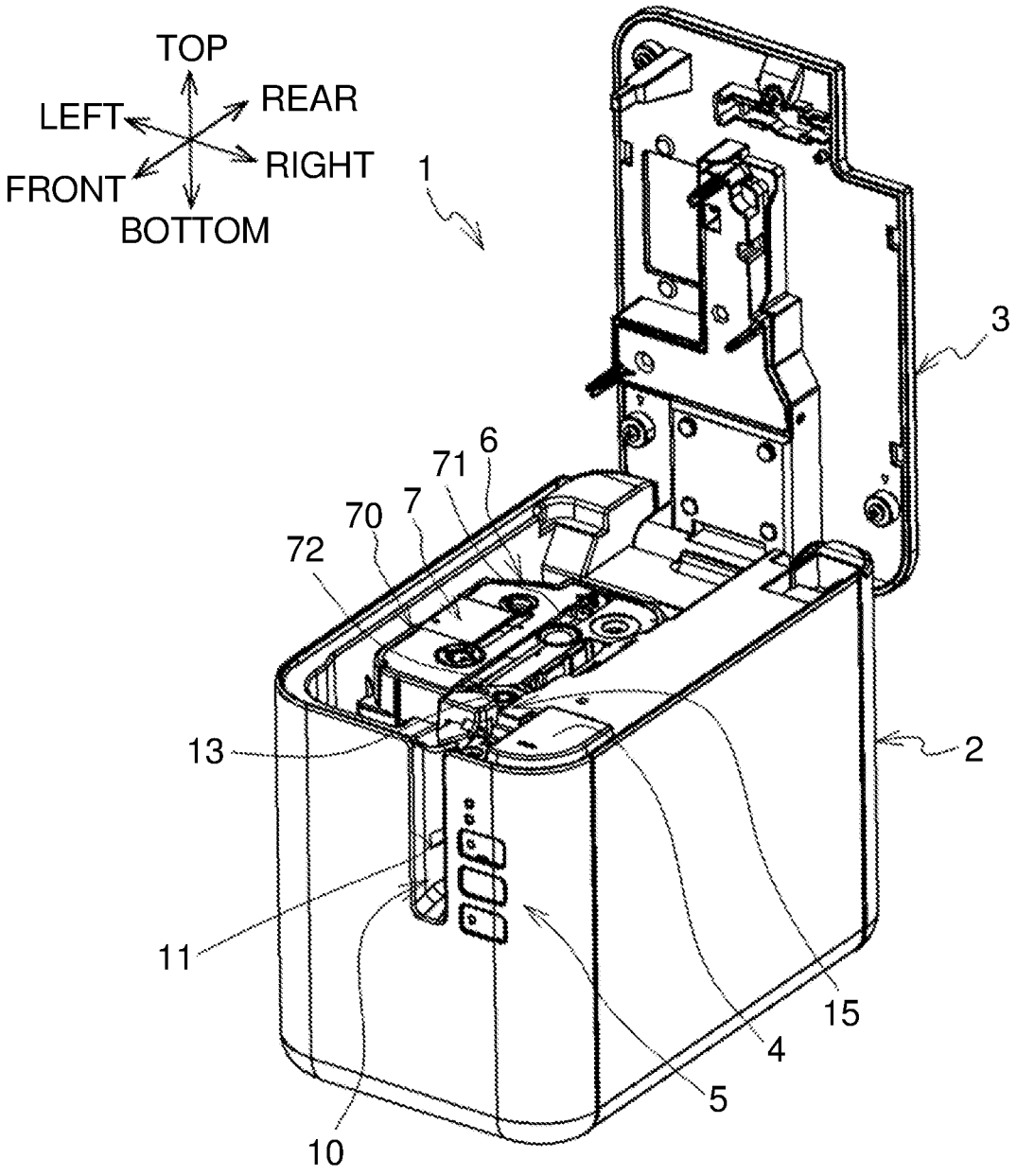
FIG. 2 is a right, top, front perspective view of the printer in the illustrative embodiment according to one or more aspects of the disclosure, wherein the cover of the printer is located at an open position and a tape cassette is completely attached to the printer.

As illustrated in FIGS. 1 and 2, the printer 1 includes a casing 2 and a cover 3. The casing 2 may have a rectangular parallelepiped shape. The cover 3 is pivotably supported by an upper rear end portion of the casing 2. The cover 3 is configured to be opened and closed selectively relative to a top of the casing 2. Hereinafter, a position at which the cover 3 is closed relative to the casing 2 may be referred to as a closed position (see FIG. 1). A position at which the cover 3 is opened relative to the casing 2 may be referred to as an open position (see FIG. 2). The cover 3 is urged toward the open position at all times by an urging member. The printer 1 further includes a lock 4 at a right-front corner of the top of the casing 2. The lock 4 is configured to retain or lock the cover 3 at the closed position. The lock 4 is further configured to, in response to pressing the lock 4, release locking of the cover 3. The lock releasing of the cover 3 allows the cover 3 to move to the open position by an urging force of the urging member. The printer 1 further includes one or more operation buttons 5 at an upper right portion of a front surface of the casing 2. The operation buttons 5 enable a user to provide various information to the printer 1. The printer 1 has an opening 11 in a front portion of the casing 2. The opening 11 is located to the left of the operation buttons 5. The opening 11 may be elongated in a top-bottom direction. The opening 11 provides communication between the inside and the outside of the casing 2.

Figure 3:
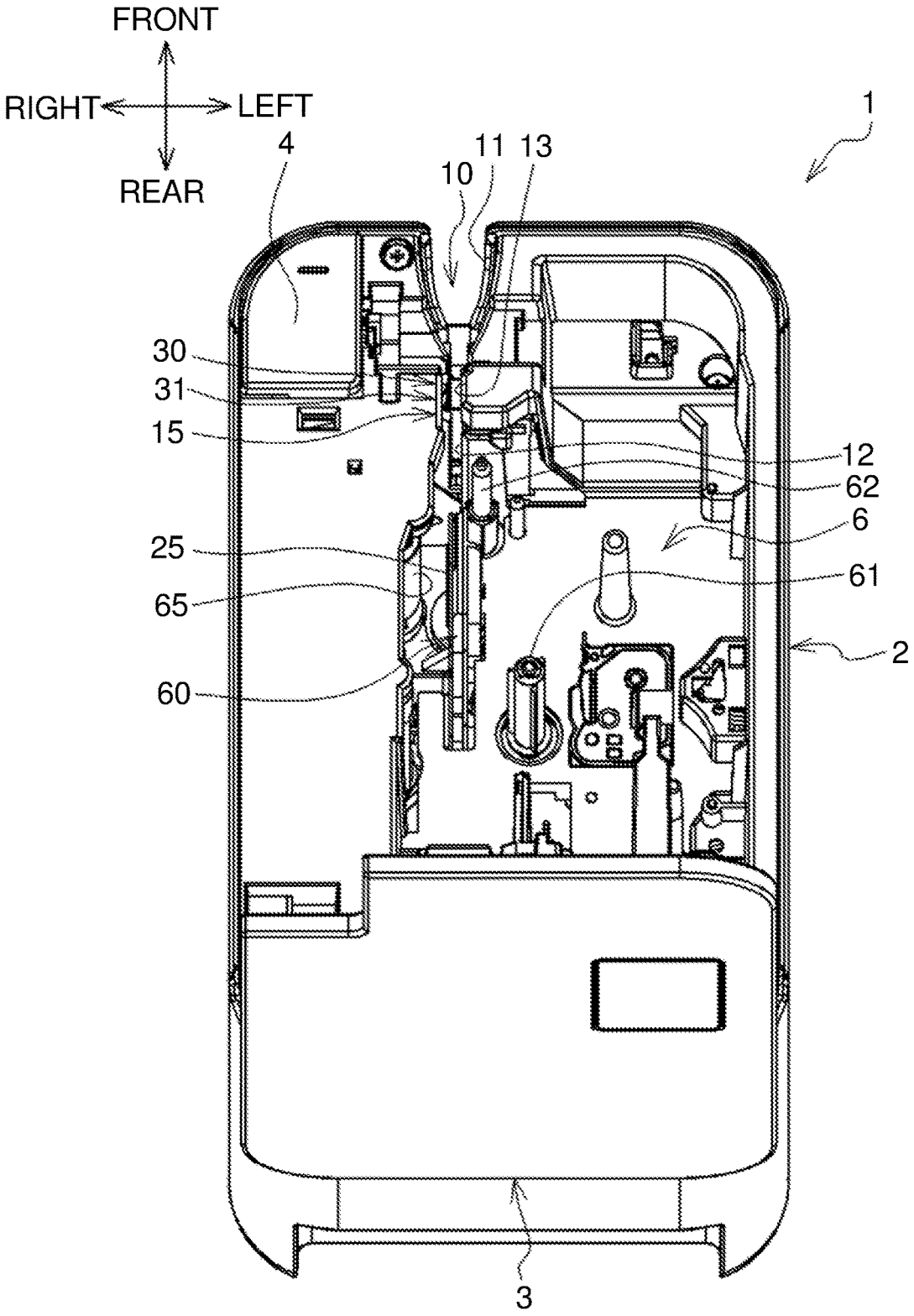
FIG. 3 is a top rear perspective view of the printer in the illustrative embodiment according to one or more aspects of the disclosure, wherein the cover of the printer is located at the open position and no tape cassette is attached to the printer.

As illustrated in FIGS. 2 and 3, the casing 2 includes a receiving portion 6 at an upper portion of the casing 2. The receiving portion 6 is recessed downward from the top of the casing 2. The receiving portion 6 is configured to receive a tape cassette 7. The tape cassette 7 is attachable to and detachable from the receiving portion 6 in the top-bottom direction. The tape cassette 7 includes a case 70. The case 70 has a box shape having a rectangular plan view. The case 70 accommodates an ink ribbon and a plurality of material layers for forming a tape 9 (refer to FIG. 4).

Figure 4:
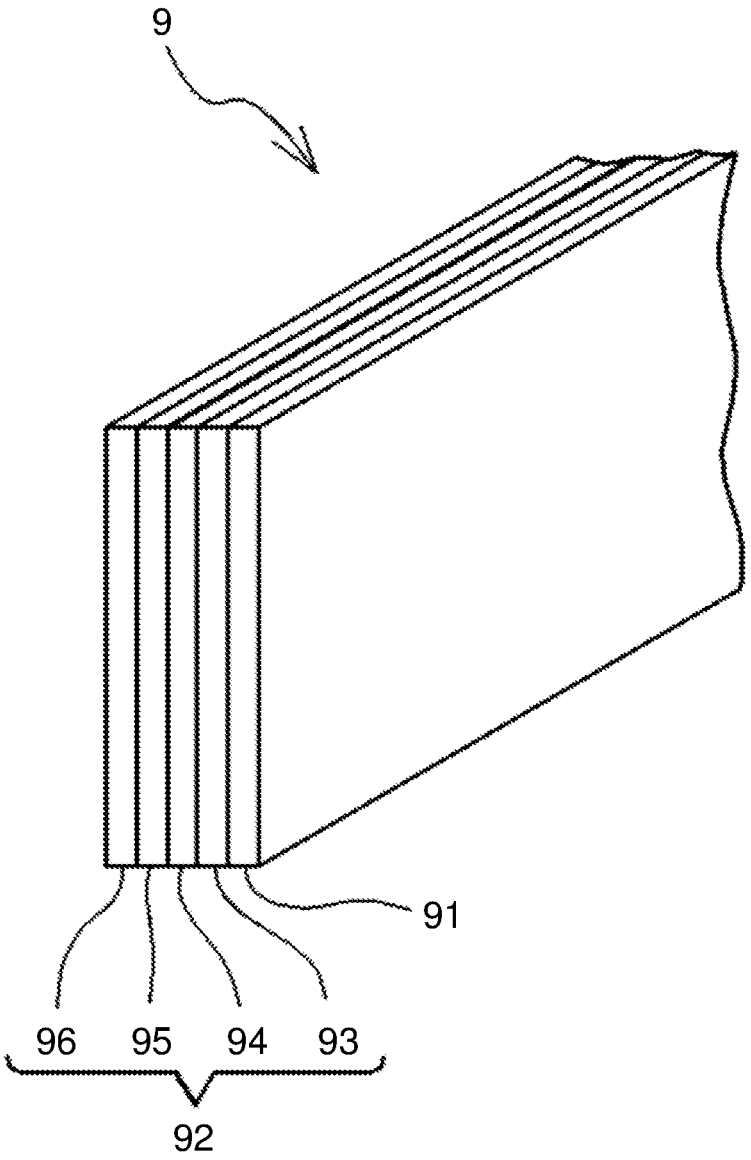
FIG. 4 is a partial perspective view of a tape in the illustrative embodiment according to one or more aspects of the disclosure.

As illustrated in FIG. 4, in the illustrative embodiment, for example, the plurality of material layers for the tape 9 includes a printing base 91 and an adhesive tape 92. The tape 9 includes a lamination of the printing base 91 and the adhesive tape 92. The printing base 91 may be a continuous strip of transparent film tape. The printing base 91 has a printing surface on its one side. The printing surface may be subject to printing by the printer 1. In the tape 9, the adhesive tape 92 is adhered to the printing surface of the printing base 91. The adhesive tape 92 includes a plurality of layers such as an adhesive layer 93, a backing base 94, an adhesive layer 95, and a release sheet 96. The adhesive layer 93 is sandwiched between the backing base 94 and the printing base 91. The adhesive layer 95 is sandwiched between the backing base 94 and the release sheet 96. More specifically, for example, the adhesive layers 93 and 95 may be provided on respective sides of the backing base 94 by application of an adhesive thereto.

As illustrated in FIG. 2, the case 70 includes a take-up spool 71 and an advance roller 72. The take-up spool 71 and the advance roller 72 each have a cylindrical shape extending in the top-bottom direction. The take-up spool 71 is configured to wind a used portion of the ink ribbon therearound. The advance roller 72 is configured to advance the tape 9.

As illustrated in FIG. 3, the printer 1 further includes a thermal head 25, and drive shafts 61 and 62 at the receiving portion 6. The printer 1 further includes a head holder 60. The thermal head 25 is located at a right surface of the head holder 60. The thermal head 25 is configured to perform printing on a portion of the printing base 91. The head holder 60 is disposed at a right portion of the receiving portion 6. The head holder 60 has a plate shape in side view. The drive shaft 61 is rotatably disposed to the left of the head holder 60. The drive shaft 61 extends in the top-bottom direction. The drive shaft 62 is rotatably disposed in front of the head holder 60. The drive shaft 62 extends in the top-bottom direction. The drive shafts 61 and 62 are both connected to a motor 26 (refer to FIG. 9). The printer 1 further includes a platen roller 65 and an auxiliary roller 66 (refer to FIG. 6) on the right of the receiving portion 6. The platen roller 65 and the auxiliary roller 66 are configured to rotate counterclockwise in plan view. The auxiliary roller 66 is disposed in front of the platen roller 65. The platen roller 65 and the auxiliary roller 66 are configured to move substantially in the right-left direction. More specifically, for example, the platen roller 65 and the auxiliary roller 66 are configured to move relatively toward and away from the thermal head 25 and the drive shaft 62, respectively.

The casing 2 further has a space 10 including a cavity 15. The cavity 15 is located in front of a right front corner of the receiving portion 6. The cavity 15 extends downward from the top of the casing 2. The cavity 15 further continuously extends frontward from the right front corner of the receiving portion 6 to the front of the casing 2. The cavity 15 defines a portion of the space 10. The space 10 includes a portion of an area H used for advancing the tape 9 (refer to FIG. 7A). The space 10 has an open rear end that may be an upstream end in a tape advance direction, and an open front end that may be a downstream end in the tape advance direction. The printer 1 further includes a cutting device 31 at a substantially middle portion of the space 10 in the front-rear direction. The cutting device 31 extends in the top-bottom direction. The space 10 includes openings 11, 12, and 13. The opening 11 may be a tape exit. The opening 11 may be located downstream from the cutting device 31 in the tape advance direction. The printer 1 is configured to discharge a tape 9 that has undergone printing to the outside of the casing 2 via the opening 11. The opening 12 may be a tape entrance. The opening 12 may be located upstream from the cutting device 31 in the tape advance direction. The opening 12 is in communication with the receiving portion 6. The opening 12 enables a tape 9 discharged from the tape cassette 7 to enter the space 10. The opening 13 may be located above the cutting device 31. The opening 13 enables a protruding portion of a tape 9 to enter the space 10 from above during attachment of the tape cassette 7 to the receiving portion 6. The opening 11 and the opening 13 are in communication with each other. The opening 12 and the opening 13 are in communication with each other.

Figure 5:
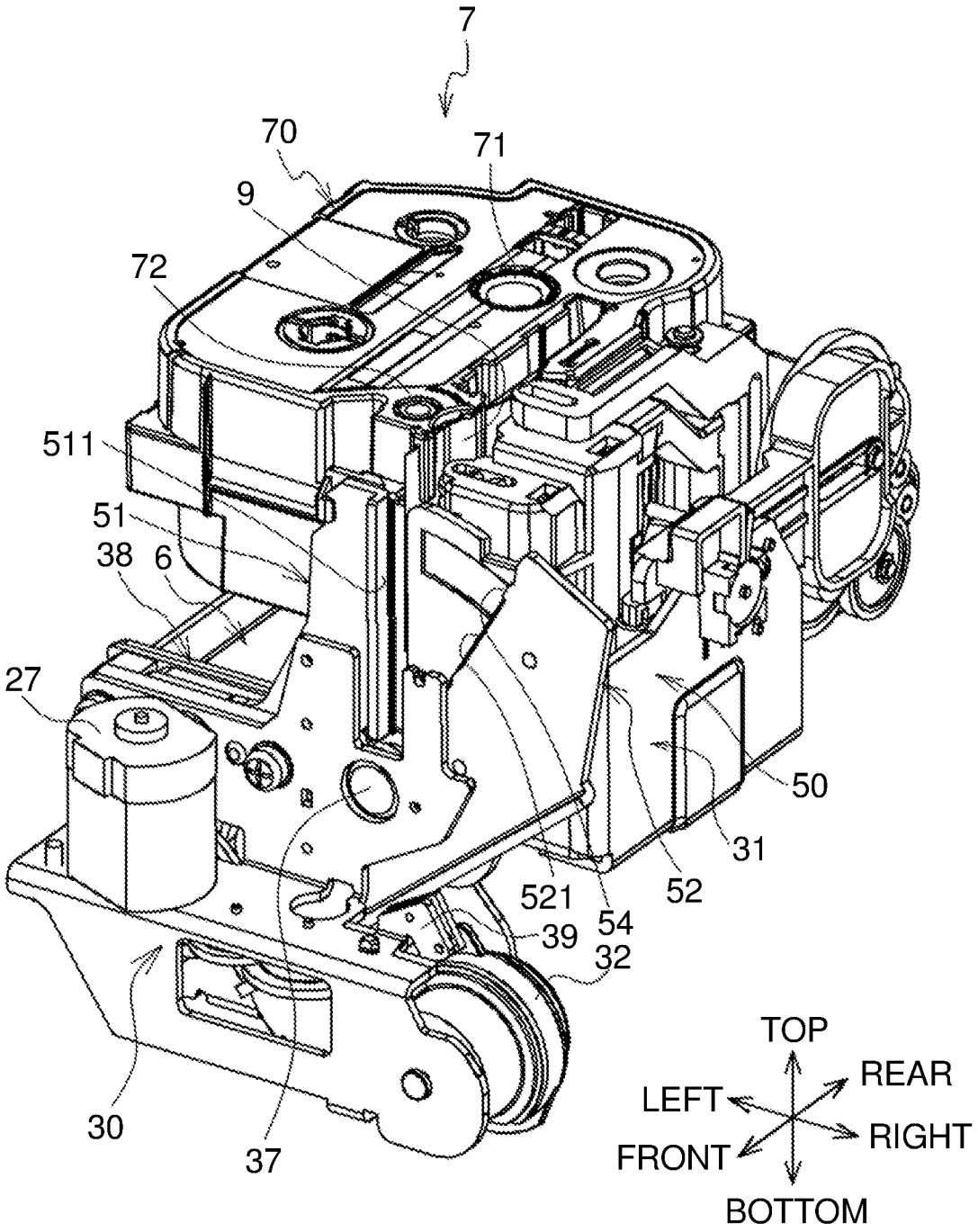
FIG. 5 is a right, top, front perspective view of a cutting mechanism including a cutter for full cutting and a cutter for partial cutting, and the tape cassette completely attached to a receiving portion of the printer in the illustrative embodiment according to one or more aspects of the disclosure.

The printer 1 further includes a cutting mechanism 30. The cutting mechanism 30 according to the illustrative embodiment may have the same or similar configuration to the cutting mechanism disclosed in Japanese Laid-Open Patent Publication No. 2005-53177. Therefore, referring to FIGS. 5 and 6, the cutting mechanism 30 will be described briefly. The cutting mechanism 30 is disposed in front of the opening 12 and behind the opening 11 (refer to FIG. 3). In other words, the cutting mechanism 30 is disposed between the opening 12 and the opening 11 in the front-rear direction. As illustrated in FIG. 5, the cutting mechanism 30 includes the cutting device 31 and a motor 27. The cutting device 31 is disposed in the casing 2. The cutting device 31 is configured to cut at least a portion of the tape 9. The cutting device 31 includes a cutter 40 (refer to FIG. 6) and a cutter 50 (refer to FIG. 5).

Figure 6:
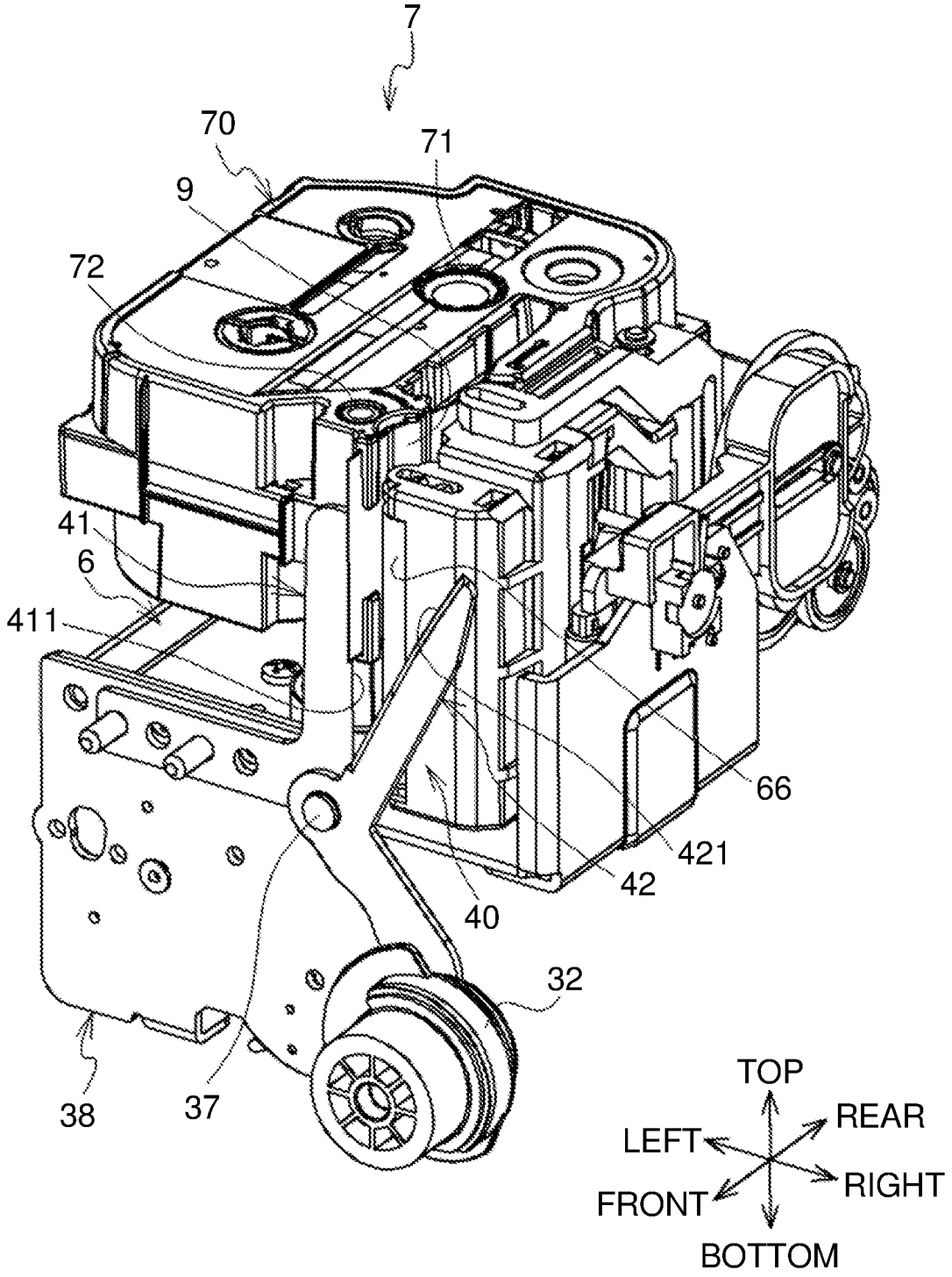
FIG. 6 is a right, top, front perspective view of the cutting mechanism and the tape cassette completely attached to the receiving portion of the printer in the illustrative embodiment according to one or more aspects of the disclosure, wherein the cutter for partial cutting and a motor are omitted.

As illustrated in FIG. 6, the cutter 40 includes a fixed blade 41 and a movable blade 42. The cutter 40 is configured to perform full cutting on a tape 9. In full cutting, for example, the cutter 40 cuts all of the layers (e.g., the printing base 91 and the adhesive tape 92) of a tape 9 to separate a printed portion of the tape 9 from the remainder. The fixed blade 41 is located to the left of the area H. The fixed blade 41 has an L-shape in rear view. The fixed blade 41 includes a lower portion that is located below a bottom wall defining the cavity 15. The fixed blade 41 further includes an upper end that is located below and adjacent to an upper end of one of side walls defining the cavity 15. The fixed blade 41 has a cutting edge 411 at its right edge. The cutting edge 41 extends in the top-bottom direction. The fixed blade 41 is fixed to a retaining plate 38. The retaining plate 38 is fixed to the casing 2. The retaining plate 38 extends in directions perpendicular to the front-rear direction. The fixed blade 41 includes a pivot 37 at its lower portion. The pivot 37 is located below the bottom wall defining the cavity 15. The pivot 37 extends in the front-rear direction. The movable blade 42 is disposed such that its cutting edge 421 faces the cutting edge 411 of the fixed blade 41 from the right. The movable blade 42 has a V-shape opened toward the right in front view. The movable blade 42 has the cutting edge 421 at its left edge. The cutting edge 421 extends substantially in the top-bottom direction. The movable blade 42 is supported by the pivot 37 so as to be pivotable about the pivot 37 clockwise or counterclockwise when viewed from the front. As the movable blade 42 pivots clockwise about the pivot 37 when viewed from the front, an upper end of the movable blade 42 moves toward the upper end of the fixed blade 41. As the movable blade 42 pivots counterclockwise about the pivot 37 when viewed from the front, the upper end of the movable blade 42 moves away from the upper end of the fixed blade 41.

As illustrated in FIG. 5, the cutter 50 includes a stopper 51 and a movable blade 52. The cutter 50 is configured to perform partial cutting on a tape 9. In partial cutting, for example, the cutter 50 cuts one or more (e.g., the printing base 91, the adhesive layer 93, the backing base 94, and the adhesive layer 95) but not all of the layers of a tape 9 so as not to separate a printed portion of the tape 9 from the remainder. More specifically, for example, the cutter 50 does not cut the release sheet 96 of the tape 9. The stopper 51 is located to the left of the area H. The stopper 51 has an L-shape in rear view. The stopper 51 includes a lower portion that is located below the bottom wall defining the cavity 15. The stopper 51 further includes an upper end that is located below and adjacent to the upper end of the one of the side walls defining the cavity 15. The stopper 51 has a contactable surface 511 at its right end. The contactable surface 511 may face a printed portion of the tape 9. The stopper 51 is located in front of the fixed blade 41 of the cutter 40 and is fixed to the retaining plate 38. The movable blade 52 is located in front of the movable blade 42. The movable blade 52 has a plate shape extending in directions perpendicular to the front-rear direction. The movable blade 52 has a cutting edge 521 at its left edge. The cutting edge 521 extends substantially in the top-bottom direction. The movable blade 52 is disposed such that its cutting edge 521 faces the stopper 51 from the right. The movable blade 52 includes a protrusion 54 at an upper end portion of the cutting edge 521. The protrusion 54 slightly protrudes toward the stopper 51 from the movable blade 52. The movable blade 52 is supported by the pivot 37 of the fixed blade 41 of the cutter 40 so as to be pivotable about the pivot 37 clockwise or counterclockwise when viewed from the front. As the movable blade 52 pivots clockwise about the pivot 37 when viewed from the front, an upper end of the movable blade 52 moves toward the upper end of the stopper 51. As the movable blade 52 pivots counterclockwise about the shaft 37 when viewed from the front, the upper end of the movable blade 52 moves away from the upper end of the stopper 51.

The motor 27 is configured to rotate selectively in a forward direction and in a reverse direction. The motor 27 is connected to each of the movable blade 42 and the movable blade 52 via a gear 32. The gear 32 is configured to transfer a driving force from the motor 27 to one or the other of the movable blade 42 and the movable blade 52. The printer 1 further includes a sensor 39. The sensor 39 is disposed above the gear 32. The sensor 39 may be a leaf switch including a movable portion and a fixed portion. The sensor 39 is configured to, in response to contact of the movable portion to the fixed portion, output a detection signal.

Referring to FIGS. 7A to 8E, a description will be provided on how the movable blades 42 and 52 move respectively. FIGS. 7A to 7E each illustrate a positional relationship between the space 10 (more specifically, the opening 11) and the cutter 40 when the printer 1 is viewed from the front. In FIGS. 7A to 7E, a portion of the cutter 40 visible through the opening 11 is indicated by a solid line, and a portion of the cutter 40 invisible through the opening 11 is indicated by a dashed line. FIGS. 8A to 8E each illustrate a positional relationship between the space 10 (more specifically, the opening 11) and the cutter 50 when the printer 1 is viewed from the front. In FIGS. 8A to 8E, likewise, a portion of the cutter 50 visible through the opening 11 is indicated by a solid line, and a portion of the cutter 50 invisible through the opening 11 is indicated by a dashed line.

Figure 7A:
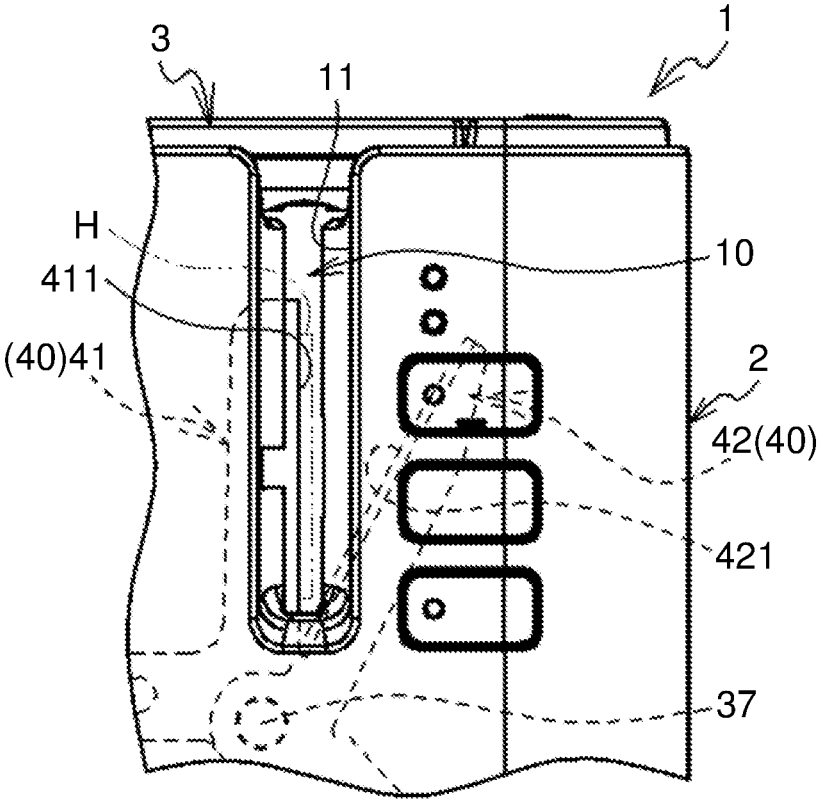
FIG. 7A is a partial front view of the printer in the illustrative embodiment according to one or more aspects of the disclosure, wherein a movable blade of the cutter for full cutting is located at a concealed position.
Figure 7B:
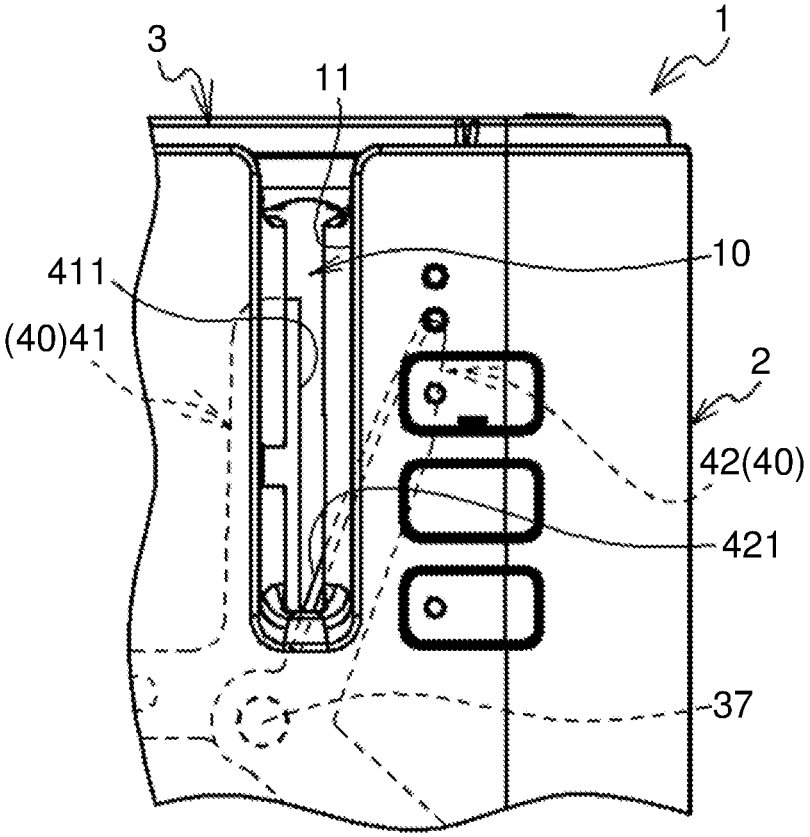
FIG. 7B is a partial front view of the printer in the illustrative embodiment according to one or more aspects of the disclosure, wherein the movable blade of the cutter for full cutting is located at a first stop position.
Figure 7C:
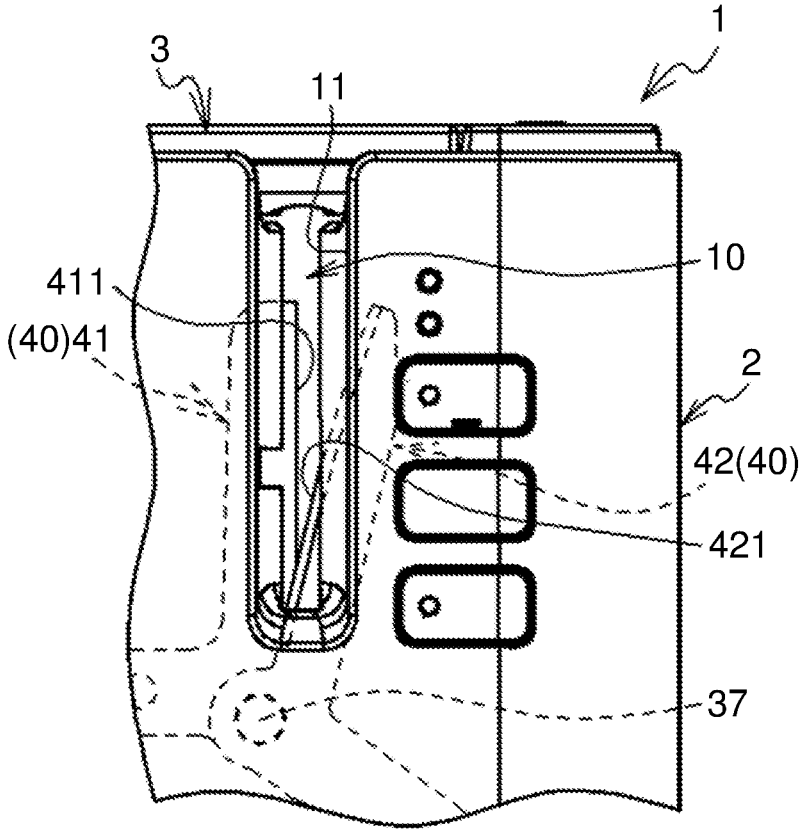
FIG. 7C is a partial front view of the printer in the illustrative embodiment according to one or more aspects of the disclosure, wherein the movable blade of the cutter for full cutting is located at a second stop position.
Figure 7D:
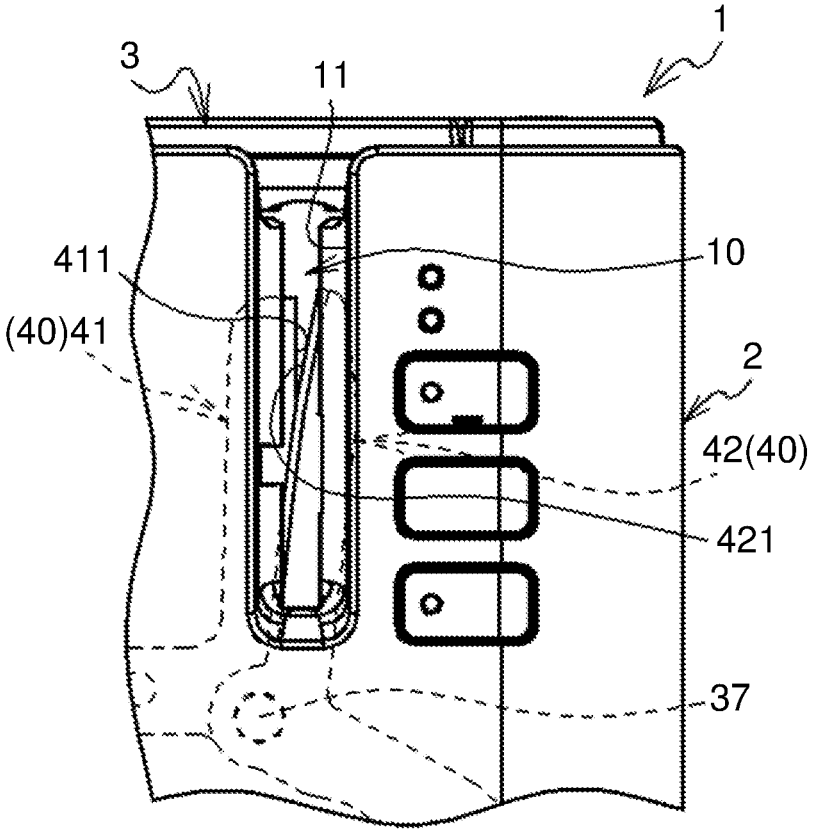
FIG. 7D is a partial front view of the printer in the illustrative embodiment according to one or more aspects of the disclosure, wherein the movable blade of the cutter for full cutting is located at a third stop position.
Figure 7E:
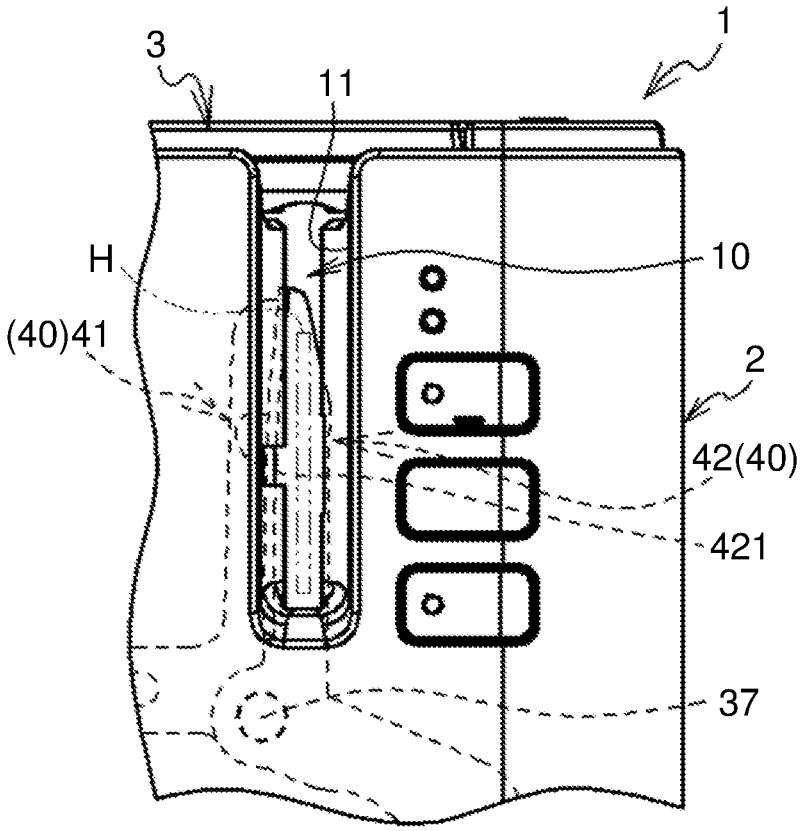
FIG. 7E is a partial front view of the printer in the illustrative embodiment according to one or more aspects of the disclosure, wherein the movable blade of the cutter for full cutting is located at a cutting position.

As illustrated in FIGS. 7A to 7E, the movable blade 42 is configured to move between a concealed position (refer to FIG. 7A) and a cutting position (refer to FIG. 7E) by pivoting about the pivot 37. As illustrated in FIG. 7A, when the movable blade 42 is located at the concealed position, the upper end of the movable blade 42 is located to the right of and apart from the upper end of the fixed blade 41. In such a state, the movable blade 42 is located entirely out of the area H, i.e., does not overlap with the area H, and is thus invisible through the opening 11. As illustrated in FIG. 7E, when the movable blade 42 is located at the cutting position, the movable blade 42 is located in front of the fixed blade 41 and the movable blade 42 overlaps the fixed blade 41 with their cutting edges 421 and 411 having slid past each other. In such a state, the movable blade 42 overlaps with the area H when viewed from the front. In other words, the movable blade 42 is located in the area H and is thus visible through the opening 11.

In the cutter 40, the movable blade 42 pivots from the concealed position (refer to FIG. 7A) to the cutting position (refer to FIG. 7E) to enable the cutting edge 411 of the fixed blade 41 and the cutting edge 421 of the movable blade 42 to pinch the tape 9 therebetween. The cutter 40 thus performs full cutting to cut all of the layers of the tape 9 completely using the fixed blade 41 and the movable blade 42 to separate a printed portion of the tape 9 from the remainder.

Figure 8A:
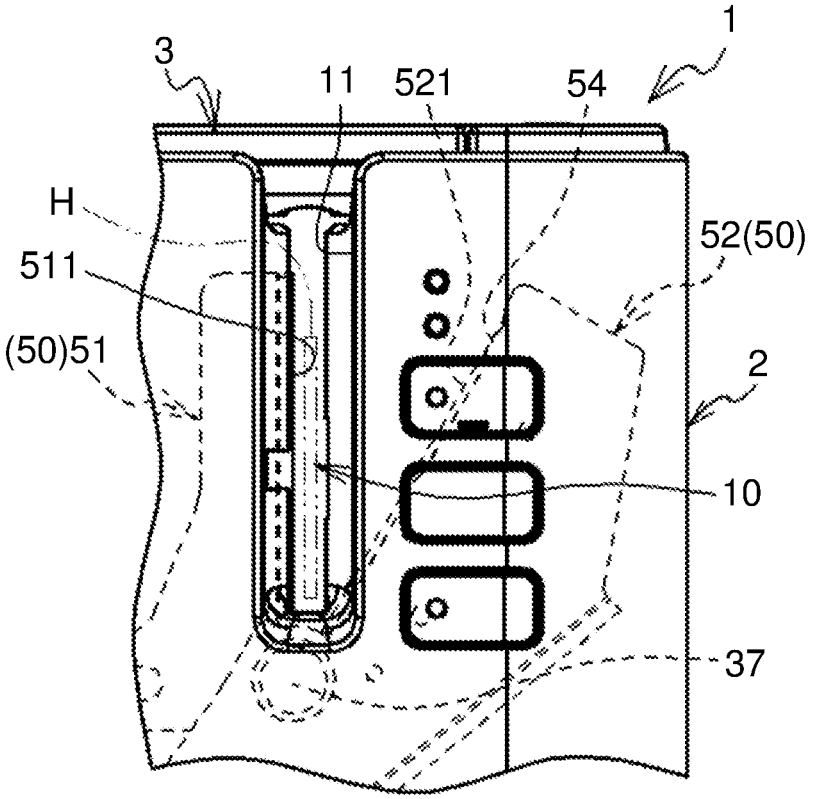
FIG. 8A is a partial front view of the printer in the illustrative embodiment according to one or more aspects of the disclosure, wherein a movable blade of the cutter for partial cutting is located at a concealed position.
Figure 8B:
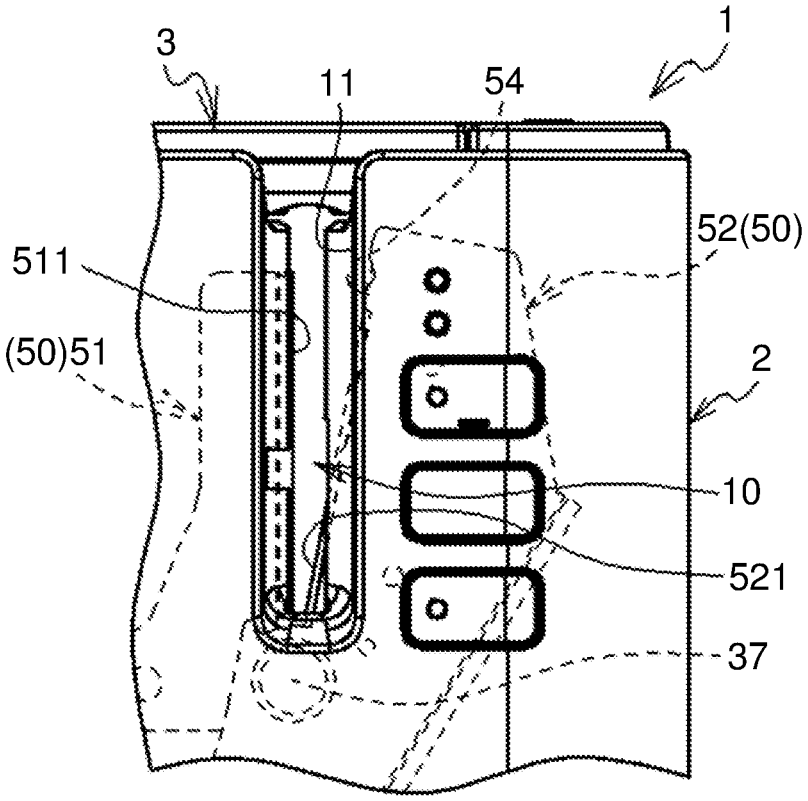
FIG. 8B is a partial front view of the printer in the illustrative embodiment according to one or more aspects of the disclosure, wherein the movable blade of the cutter for partial cutting is located at a first stop position.
Figure 8C:
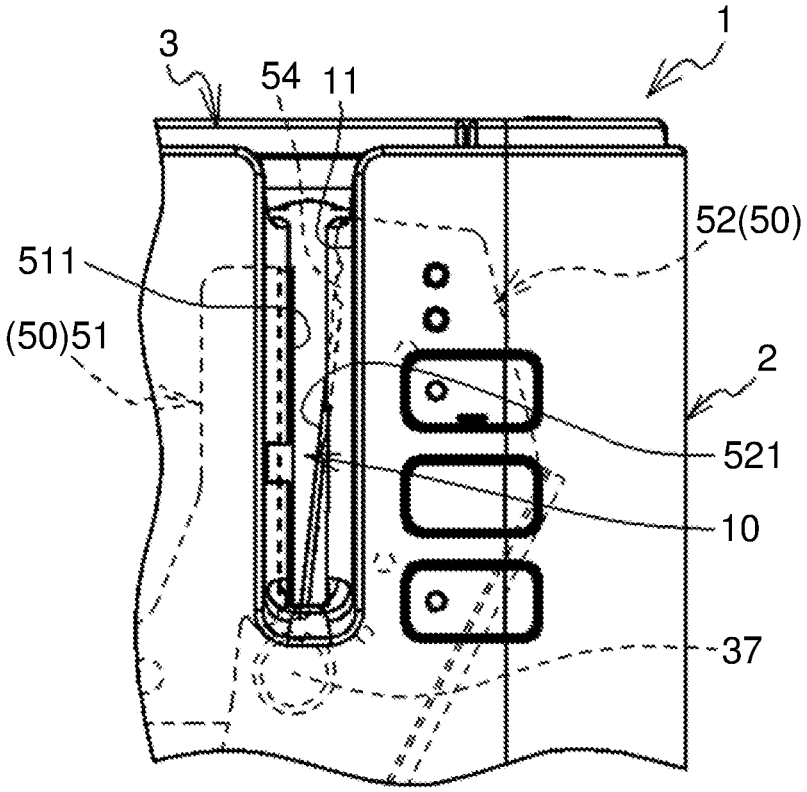
FIG. 8C is a partial front view of the printer in the illustrative embodiment according to one or more aspects of the disclosure, wherein the movable blade of the cutter for partial cutting is located at a second stop position.
Figure 8D:
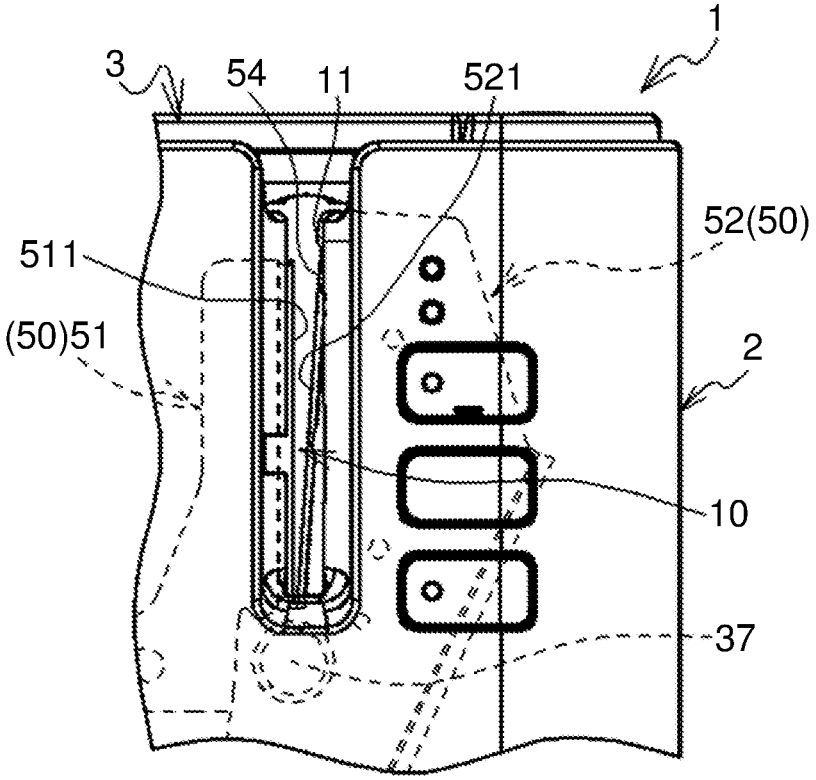
FIG. 8D is a partial front view of the printer in the illustrative embodiment according to one or more aspects of the disclosure, wherein the movable blade of the cutter for partial cutting is located at a third stop position.
Figure 8E:
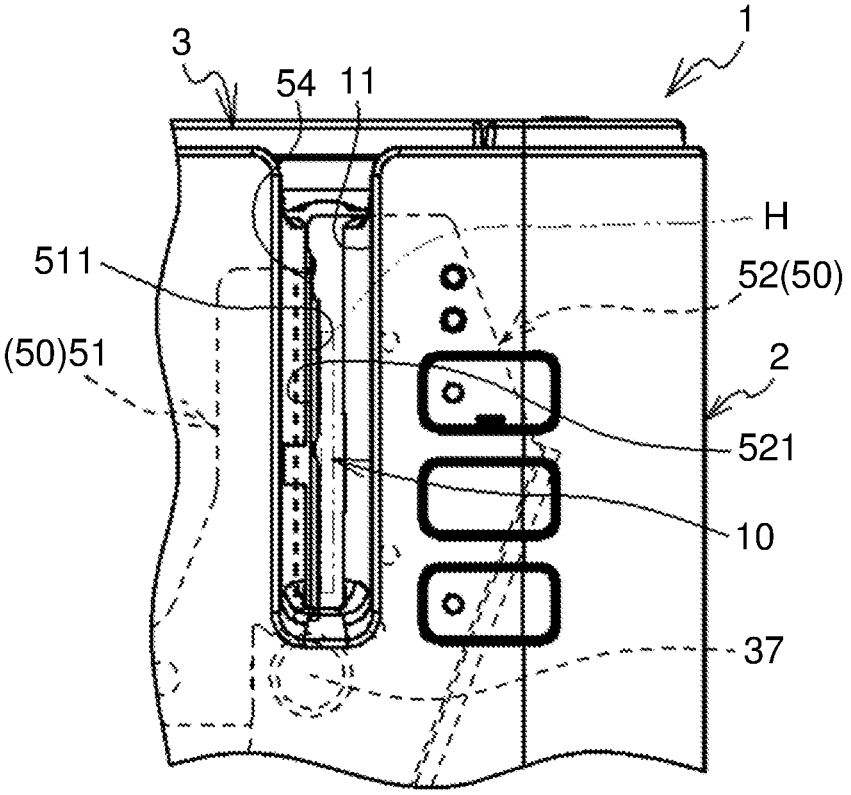
FIG. 8E is a partial front view of the printer in the illustrative embodiment according to one or more aspects of the disclosure, wherein the movable blade of the cutter for partial cutting is located at a cutting position.

As illustrated in FIGS. 8A to 8E, the movable blade 52 is configured to move between a concealed position (refer to FIG. 8A) and a cutting position (refer to FIG. 8E) by pivoting about the pivot 37. As illustrated in FIG. 8A, when the movable blade 52 is located at the concealed position, the upper end of the movable blade 52 is located to the right of and apart from the upper end of the stopper 51. In such a state, the movable blade 52 is located entirely out of the area H, i.e., does not overlap with the area H, and is thus invisible through the opening 11. As illustrated in FIG. 8E, when the movable blade 52 is located at the cutting position, the protrusion 54 of the movable blade 52 is in contact with the contactable surface 511 of the stopper 51. Thus, a predetermined gap is left between the contactable surface 511 of the stopper 51 and the cutting edge 521 of the movable blade 52. That is, when the movable blade 52 is located at the cutting position, the cutting edge 521 of the movable blade 52 is located adjacent to the contactable surface 511 with the predetermined gap being left therebetween. In such a state, the movable blade 52 overlaps with the area H when viewed from the front. In other words, the movable blade 52 is located in the area H and is thus visible through the opening 11. The predetermined gap is smaller than a thickness of the tape 9. In the illustrative embodiment, the predetermined gap is substantially equal to a thickness of the release sheet 96.

In the cutter 50, the movable blade 52 pivots from the concealed position (refer to FIG. 8A) to the cutting position (refer to FIG. 8A) to place the tape 9 in the predetermined gap. The cutting edge 521 of the movable blade 52 then presses the tape 9 against the contactable surface 511 of the stopper 51. The cutter 50 thus performs partial cutting to cut one or more (e.g., the printing base 91, the adhesive layer 93, the backing base 94, and the adhesive layer 95) but not all of the layers of the tape 9 using the stopper 51 and the movable blade 52 so as not to separate a printed portion of the tape 9 from the remainder.

Hereinafter, the position of the motor 27 (refer to FIG. 5) when the movable blades 42 and 52 are located at the respective concealed positions may be referred to as an "initial position". Forward rotation of the motor 27 from the initial position may enable the movable blade 42 to move toward the cutting position. In a state where the movable blade 42 is located at any position other than the concealed position, reverse rotation of the motor 27 to the initial position may enable the movable blade 42 to move back to the concealed position. Reverse rotation of the motor 27 from the initial position may enable the movable blade 52 to move toward the cutting position. In a state where the movable blade 52 is located at any position other than the concealed position, forward rotation of the motor 27 to the initial position may enable the movable blade 52 to move back to the concealed position. That is, switching of the rotating direction of the motor 27 with reference to the initial position may enable the cutting device 31 to selectively perform full cutting or partial cutting.

When the motor 27 is located at the initial position, a portion of the gear 32 is in contact with the movable portion of the sensor 39 (refer to FIG. 5). That is, a contact of the movable portion to the fixed portion by movement of the movable portion may cause the sensor 39 to output a detection signal. In response to detecting the detection signal outputted by the sensor 39, the printer 1 may determine that the motor 27 is located at the initial position, that is, the movable blades 42 and 52 are located at the respective concealed positions (refer to FIGS. 7A and 8A).

As illustrated in FIGS. 7B, 7C, 7D, 8B, 8C, and 8D, a plurality of stop positions are provided between the concealed position and the cutting position for each of the movable blades 42 and 52. That is, each of the movable blades 42 and 52 moves between its corresponding concealed position and cutting position through a plurality of corresponding stop positions. The stop positions are provided for cleaning the movable blades 42 and 52. The stop positions for each of the movable blades 42 and 52 include, for example, a first stop position (refer to FIGS. 7B and 8B), a second stop position (refer to FIGS. 7C and 8C), and a third stop position (refer to FIGS. 7D and 8D). At each of the first, second, and third stop positions, at least a portion of the cutting edge 421 of the movable blade 42 or at least a portion of the cutting edge 521 of the movable blade 52 is located at the space 10. The movable blade 42 moves from the concealed position to the cutting position via the first stop position, the second stop position, and the third stop position in this order. Likewise, the movable blade 52 moves from the concealed position to the cutting position via the first stop position, the second stop position, and the third stop position in this order. That is, a distance between the upper end of the movable blade 42 and the upper end of the fixed blade 41 decreases with the position change of the movable blade 42 from the first stop position to the second stop position, and further decreases with the position change of the movable blade 42 from the second stop position to the third position. Likewise, the distance between the upper end of the movable blade 52 and the upper end of the stopper 51 decreases with the position change of the movable blade 52 from the first stop position to the second stop position, and further decreases with the position change of the movable blade 52 from the second stop position to the third position.

Referring to FIGS. 2 and 3, a printing operation performed by the printer 1 will be described. When the cover 3 is located at the open position, the receiving portion 6 and the cavity 15 are exposed or opened upward. In such a state, the tape cassette 7 is allowed to be attached to the receiving portion 6. In a state where the tape cassette 7 is completely attached to the receiving portion 6, the take-up spool 71 is engaged with the drive shaft 61 of the printer 1 and the advance roller 72 is engaged with the drive shaft 62 of the printer 1. In response to closing of the cover 3, the platen roller 65 and the auxiliary roller 66 move relatively toward the thermal head 25 and the drive shaft 62 and stay close thereto, respectively. Such movement enables the platen roller 65 to press the printing base 91 against the thermal head 25 with placing a portion of the ink ribbon on the printing surface of the printing base 91. While the printing base 91 passes between the auxiliary roller 66 and the advance roller 72, the printing base 91 is laminated with the adhesive tape 92 with the printing surface of the printed portion thereof facing a portion of the adhesive tape 92. The lamination of the printing base 91 and the adhesive tape 92 thus forms a tape 9. The auxiliary roller 66 presses the tape 9 against the advance roller 72. When the cover 3 is located at the closed position, the cover 3 covers the receiving portion 6 and the cavity 15 from above (refer to FIG. 1). That is, when the cover 3 is located at the closed position, the cover 3 may cover the opening 12 and the opening 13 while uncovering the opening 11.

The printer 1 performs printing while advancing the tape 9. More specifically, for example, the printer 1 causes the thermal head 25 to generate heat to apply heat to a portion of the ink ribbon. This may thus implement thermal ink transfer onto the printing base 91 from the ink ribbon, thereby printing data such as letters or characters on the printing base 91. The printer 1 causes the motor 26 (refer to FIG. 9) to rotate the drive shafts 61 and 62. Rotation of the drive shaft 61 causes the take-up spool 71 to rotate to wind a used portion of the ink ribbon therearound. Rotation of the drive shaft 62 causes the advance roller 72 to rotate to advance the tape 9 in cooperation with the auxiliary roller 66 while the advance roller 72 and the auxiliary roller 66 pinch the tape 9 therebetween. The tape 9 moves in an orientation in which a length of the tape 9 extends in the front-rear direction, a width of the tape 9 extends in the top-bottom direction, and a thickness of the tape 9 extends in the right-left direction. More specifically, for example, the printing base 91 faces to the right (e.g., faces to the movable blades 42 and 52) and the adhesive tape 92 faces to the left (e.g., faces to the fixed blade 41 and the stopper 51). The tape 9 exits from the tape cassette 7 and then enters the space 10 via the opening 12. The printer 1 causes the motor 27 (refer to FIG. 9) to move an appropriate one of the movable blades 42 and 52 from the concealed position (refer to FIG. 7A or FIG. 8A) to the cutting position (refer to FIG. 7E or FIG. 8E). The printer 1 thus completely cuts a printed portion of the tape 9 using the cutter 40 (e.g., full cutting) or incompletely cuts the printed portion of the tape 9 using the cutter 50 (e.g., partial cutting). The printer 1 discharges, to the outside of the printer 1, the printed portion of the tape 9 via the opening 11.

Figure 9:
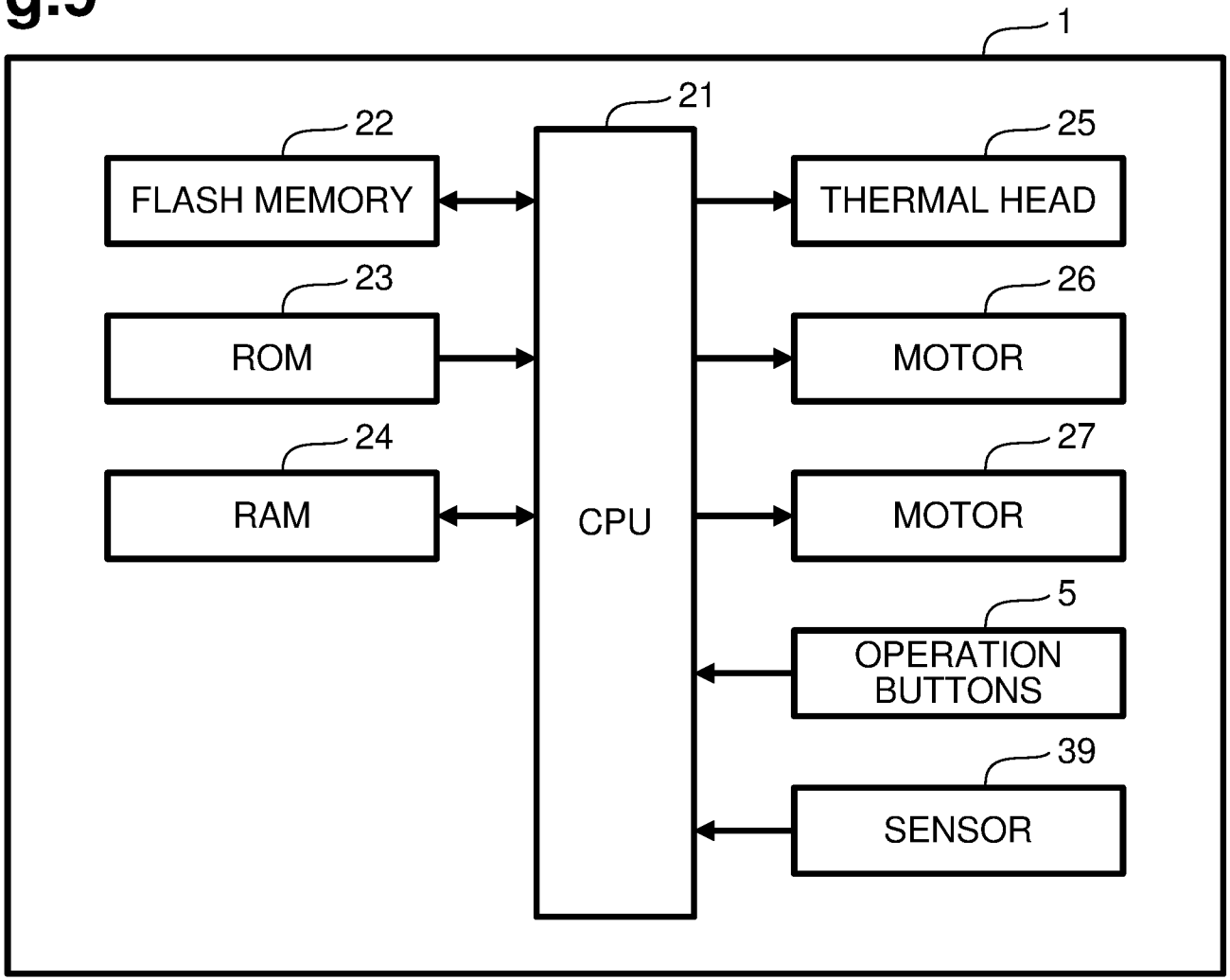
FIG. 9 is an electrical configuration of the printer in the illustrative embodiment according to one or more aspects of the disclosure.

Referring to FIG. 9, an electrical configuration of the printer 1 will be described. The printer 1 includes a CPU 21. The CPU 21 is configured to control all operations of the printer 1. The printer 1 further includes a flash memory 22, a ROM 23, a RAM 24. The flash memory 22, the ROM 23, the RAM 24, the thermal head 25, the motor 26, the motor 27, the operation buttons 5, and the sensor 39 are each connected to the CPU 21. The flash memory 22 stores various programs including a program to be used by the CPU 21 for execution of a main process. The ROM 23 stores various parameters to be used by the CPU 21 during execution of each of the programs. More specifically, for example, the ROM 23 stores data each indicating a time period elapsing that the motor 27 rotates from the initial position to a corresponding stop position (hereinafter, referred to as "driving period data). In the illustrative embodiment, for example, the ROM 23 stores six pieces of such data. The RAM 24 stores temporary data such as values of a timer and a counter.

Figure 10:
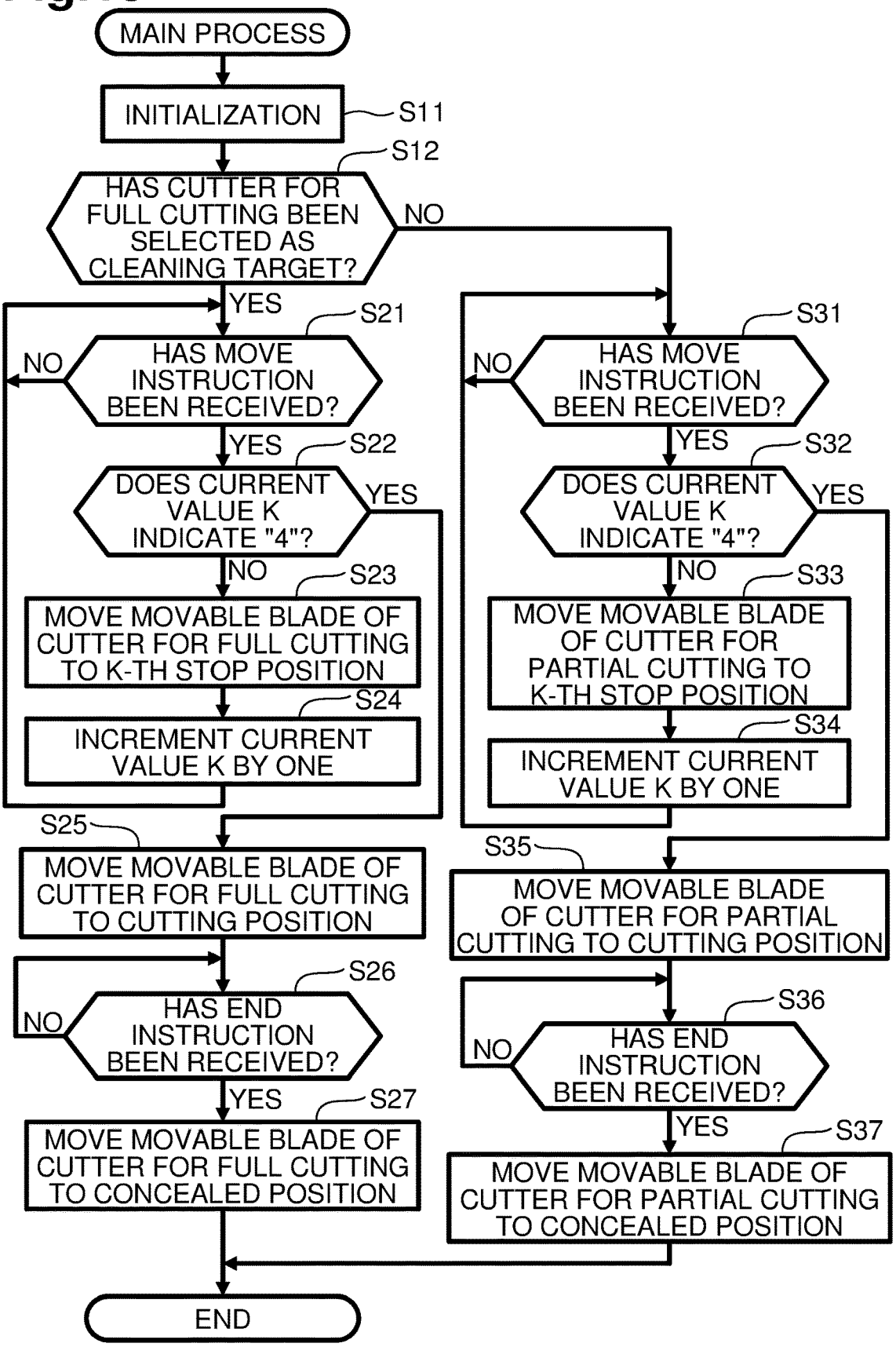
FIG. 10 is a flowchart showing a main process in the illustrative embodiment according to one or more aspects of the disclosure.

Referring to FIG. 10, the main process will be described. For cleaning the cutting device 31, a user operates one or more of the operation buttons 5 to provide an instruction for starting the main process (hereinafter, referred to as a "start instruction") to the CPU 21. In response to receiving the start instruction, the CPU 21 reads the program for execution of the main process from the flash memory 22 and executes the main process.

In step S11, the CPU 21 executes initialization. In the initialization, the CPU 21 resets the current value K of the counter to "1 (one)" and stores the reset value in the RAM 24. The CPU 21 also resets a value of the timer and stores the reset value in the RAM 24. If the motor 27 is not located at the initial position, the CPU 21 controls the motor 27 to move to the initial position. The CPU 21 determines, based on the presence or absence of a detection signal outputted by the sensor 39, whether the motor 27 is located at the initial position. If the CPU 21 determines that a detection signal outputted by the sensor 39 has been received, the motor 27 is located at the initial position. Thus, the CPU 21 controls the motor 27 to stop driving. In response to rotation of the motor 27 to the initial position, the movable blades 42 and 52 are located at the respective concealed positions (refer to FIGS. 7A and 8A). In a state where the printer 1 is not in printing operation, the motor 27 is located at the initial position normally.

In step S12, the CPU 21 determines which one of the cutter 40 and the cutter 50 is subject to cleaning. The user may select one of the cutter 40 for full cutting and the cutter 50 for partial cutting as a cleaning target by operating one or more of the operation buttons 5. If the CPU 21 determines that the cutter 40 has been selected as a cleaning target (e.g., YES in step S12), the CPU 12 executes control for cleaning the cutter 40 (e.g., steps S21 to S25).

In step S21, the CPU 21 determines whether a move instruction for driving the motor 27 to move the movable blade 42 to another position has been received. The user may provide such a move instruction to the CPU 21 by operating one or more of the operation buttons 5. If the CPU 21 determines that a move instruction has not been received (e.g., NO in step S21), the CPU 21 waits until the CPU 21 determines that a move instruction has been received. If the CPU 21 determines that a move instruction has been received (e.g., YES in step S21), in step S22, the CPU 21 determines whether the current value K of the counter indicates "4". If the CPU 21 determines that the current value K of the counter indicates one of values of "1" to "3" (e.g., NO in step S22), in step S32, the CPU 21 controls the motor 27 to rotate in the forward direction to move the movable blade 42 to a K-th stop position ("K" indicates the current value K of the counter). More specifically, the CPU 21 controls the timer to measure time elapsed since the motor 27 starts driving. In response to the time being measured elapsing the time period indicated by the driving period data that corresponds to the K-th stop position for the movable blade 42 since the motor 27 starts driving, the CPU 21 controls the motor 27 to stop driving. The CPU 21 controls the movable blade 42 to stop at each stop position with reference to the concealed position, thereby enabling the movable blade 42 to move to and stop at the K-th stop position reliably.

In step S24, the CPU 21 increments the current value K of the counter by one. Subsequent to step S24, the routine returns to step S21. Every time the CPU 21 receives a move instruction, the CPU 21 controls the movable blade 42 to move to and stop at one of the first stop position, the second stop position, and the third stop position in this order, with reference to the concealed position. That is, the movable blade 42 moves to and stops at each of the stop positions in order of increasing distance from the concealed position. If the CPU 21 determines that the current value K of the counter indicates "4" (e.g., YES in step S22), in step S25, the CPU 21 controls the motor 27 to move the movable blade 42 to the cutting position.

In response to completion of cleaning of the cutter 40 (e.g., steps S21 to S25), in step S26, the CPU 21 determines whether an end instruction for completing the main process has been received. The user may provide such an end instruction to the CPU 21 by operating one or more of the operation buttons 5. If the CPU 21 determines that an end instruction has not been received (e.g., NO in step S26), the CPU 21 waits until the CPU 21 determines that an end instruction has been received. If the CPU 21 determines that an end instruction has been received (e.g., YES in step S26), the CPU 21 controls the motor 27 to rotate in the reverse direction to move to the initial position, thereby moving the movable blade 42 to the concealed position. Subsequent to step S27, the CPU 21 ends the main process.

If, in step S12, the CPU 21 determines that the cutter 50 has been selected as a cleaning target (e.g., NO in step S12), the CPU 12 executes control for cleaning the cutter 50 (e.g., steps S31 to S35). The control for cleaning the cutter 50 (e.g., steps S31 to S35) may be the same as or similar to the control for cleaning the cutter 40 (e.g., steps S21 to S25), and therefore, a description will be omitted for the common points.

Processing executed in steps S31, S32, and S34 may be the same as or similar to the processing executed in steps S21, S22, and S24, respectively. In step S33, the CPU 21 controls the motor 27 to rotate in the reverse direction to move the movable blade 52 to the K-th stop position. More specifically, the CPU 21 controls the timer to measure time elapsed since the motor 27 starts driving. In response to the time being measured elapsing the time period indicated by the driving period data that corresponds to the K-th stop position for the movable blade 52 since the motor 27 starts driving, the CPU 21 controls the motor 27 to stop driving. The CPU 21 controls the movable blade 52 to stop at each stop position with reference to the concealed position, thereby enabling the movable blade 52 to move to and stop at the K-th stop position reliably. In step S35, the CPU 21 controls the motor 27 to move the movable blade 52 to the cutting position.

In response to completion of cleaning of the cutter 50 (e.g., steps S31 to S35), in step S36, the CPU 21 determines whether an end instruction for completing the main process has been received. If the CPU 21 determines that an end instruction has not been received (e.g., NO in step S36), the CPU 21 waits until the CPU 21 determines that an end instruction has been received. If the CPU 21 determines that an end instruction has been received (e.g., YES in step S36), the CPU 21 controls the motor 27 to rotate in the forward direction to move to the initial position, thereby moving the movable blade 52 to the concealed position. Subsequent to step S37, the CPU 21 ends the main process.

Referring to FIGS. 7A to 8E, a description will be provided on an example procedure for cleaning the cutters 40 and 50. Repeat cutting of the tape 9 may cause accumulation of foreign matter, such as dust, cuttings of the tape 9, and/or adhesive residues of the adhesive layers 93 and 95 on the cutters 40 and 50. The same procedure may be applied to cleaning of the cutter 40 and cleaning of the cutter 50, and therefore, a description will be provided on only the procedure for cleaning the cutter 40. For cleaning the cutter 40, the user may move the cover 3 of the printer 1 to the open position. The user may leave the cover 3 at the open position while cleaning the cutter 40. As illustrated in FIGS. 7A and 8A, the user may clean the fixed blade 41 while allowing the movable blades 42 and 52 to be located at the respective concealed positions. More specifically, for example, the user inserts a cleaner (e.g., a cleaning stick) into the space 10 and removes (e.g., wipes) foreign matter from the fixed blade 41 using the cleaner.

As illustrated in FIGS. 7B to 7D, the user may further clean the movable blade 42 at each stop position. More specifically, for example, as illustrated in FIG. 7B, when the movable blade 42 is located at the first stop position, a lower portion of the cutting edge 421 of the movable blade 42 is located at the space 10 without overlapping with the fixed blade 41. In such a state, the other portion (e.g., a middle portion and an upper portion) of the cutting edge 421 of the movable blade 42 is located out of the space 10. That is, the lower portion of the cutting edge 421 of the movable blade 42 is visible to the user in the space 10. The user may thus be enabled to clean the lower portion of the cutting edge 421 of the movable blade 42 using the cleaner while viewing the lower portion of the cutting edge 421 in the space 10. More specifically, for example, the user may clean the lower portion of the cutting edge 421 of the movable blade 42 by accessing that portion from the front of the printer 1 through the opening 11, from the rear of the printer 1 through the opening 12, and from above of the printer 1 through the opening 13.

As illustrated in FIG. 7C, when the movable blade 42 is located at the second stop position, the middle portion of the cutting edge 421 of the movable blade 42 is located at the space 10 without overlapping with the fixed blade 41. In such a state, the upper portion of the cutting edge 421 of the movable blade 42 is located out of the space 10. Although located at the space 10, the lower portion of the cutting edge 421 of the movable blade 42 overlaps with the fixed blade 41. That is, the middle portion of the cutting edge 421 of the movable blade 42 is visible to the user in the space 10. The user may thus be enabled to clean the middle portion of the cutting edge 421 of the movable blade 42 using the cleaner while viewing the middle portion of the cutting edge 421 in the space 10.

As illustrated in FIG. 7D, when the movable blade 42 is located at the third stop position, the upper portion of the cutting edge 421 of the movable blade 42 is located at the space 10 without overlapping with the fixed blade 41. Although located at the space 10, the lower portion and the middle portion of the cutting edge 421 of the movable blade 42 overlap with the fixed blade 41. That is, the upper portion of the cutting edge 421 of the movable blade 42 is visible to the user in the space 10. The user may thus be enabled to clean the upper portion of the cutting edge 421 of the movable blade 42 using the cleaner while viewing the upper portion of the cutting edge 421 in the space 10.

As illustrated in FIG. 7E, the user may clean the remaining portion (e.g., the portion other than the cutting edge 421) of the movable blade 42 at the cutting position while viewing that portion of the movable blade 42 in the space 10. The user may thus complete cleaning of the entirety of the movable blade 42. The procedure for cleaning the cutter 40 is merely an example.

As described above, when the movable blade 42 is located at any one of its stop positions, at least a portion of the movable blade 42 is located at the space 10. Likewise, when the movable blade 52 is located at any one of its stop positions, at least a portion of the movable blade 52 is located at the space 10. The user may thus be enabled to clean at least the portion of the movable blade 42 or the movable blade 52 visible in the space 10. Accordingly, the printer 1 may ensure continued sufficiency of cutting performance of the cutting device 31.

In the illustrative embodiment, the space 10 includes the opening 11, thereby enabling the user to readily clean the downstream surface of each of the movable blades 42 and 52 in the tape advance direction while viewing the surface through the opening 11. The space 10 further includes the opening 12, thereby enabling the user to readily clean the upstream surface of each of the movable blades 42 and 52 in the tape advance direction while viewing the surface through the opening 12. In addition, the space 10 includes the opening 13, thereby enabling the user to readily clean each of the movable blades 42 and 52 while viewing the movable blades 42 and 52 from above through the opening 13.

In the illustrative embodiment, when the cover 3 is located at the closed position, the cover 3 may uncover the opening 11 of the cavity 15. In other words, the opening 11 may be exposed. This configuration may thus enable the user to clean the cutting device 31 through the opening 11 without locating the cover 3 at the open position. When the cover 3 is located at the closed position, the cover 3 may cover the opening 12 and the opening 13. This configuration may thus reduce or prevent intrusion of foreign matter into the inside of the printer 1 through the opening 12 and the opening 13. Accordingly, such a configuration may reduce or prevent adhesion of foreign matter to the cutting device 31 due to intrusion of foreign matter into the inside of the printer 1 through the space 10.

The cutter 40 may include the fixed blade 41 and the movable blade 42. For example, the cutter 40 may cut all of the layers of the tape 9 completely to separate a portion of the tape 9 from the remainder with such a simple structure. The cutter 50 may include the stopper 51 and the movable blade 52. For example, the cutter 50 may cut the tape 9 incompletely, e.g., may cut one or more but not all of the layers of the tape 9, with such a simple structure. Accordingly, the printer 1 may cut at least a portion of the tape 9 with such a simple structure. For example, the printer 1 may cut at least a single layer of the layers of the tape 9 with such a simple structure.

If the stop positions for the respective movable blades 42 and 52 are defined out of their respective moving routes between the concealed position and the cutting position, the printer 1 may need to have a space for moving the movable blades 42 and 52 to the respective corresponding stop positions. Nevertheless, in the illustrative embodiment, the stop positions for the respective movable blades 42 and 52 are provided on their respective moving routes between the concealed position and the cutting position. The printer 1 might thus not need to have such a space. Accordingly, such a configuration may prevent increase in size of the printer 1.

When the movable blade 42 or 52 is located at the first stop position, the user may be enabled to clean the lower portion of the movable blade 42 or 52. When the movable blade 42 or 52 is located at the second stop position, the user may be enabled to clean the middle portion of the movable blade 42 or 52. When the movable blade 42 or 52 is located at the third stop position, the user may be enabled to clean the upper portion of the movable blade 42 or 52. Providing the plurality of stop positions may thus enable the user to clean the non-overlapping visible portion of the movable blade 42 or 52, thereby enabling the user to clean the entirety of the movable blades 42 52 eventually.

In a state where the printer 1 is not in printing operation, the movable blades 42 and 52 are located at the respective concealed positions normally. In the printer 1, the movable blade 42 or 52 may move to and stop at each of the stop positions in order of increasing distance from the corresponding concealed position. Such a control may thus prevent increase in an amount of a moving distance of each of the movable blades 42 and 52 for cleaning the cutting device 31. Accordingly, this may further prevent extension of the time required for each of the movable blades 42 and 52 to move for cleaning the movable blades 42 and 52, thereby enabling the user to clean the cutting device 31 efficiently. The movable blades 42 and 52 are both configured to pivot about the pivot 37. The pivot 37 is located at the lower portion of each of the movable blades 42 and 42. If, therefore, the user cleans each of the movable blades 42 and 52 (e.g., the cutting edges 421 and 521) from the upper portion toward the lower portion, foreign matter may adhere to the pivot 37. In the illustrative embodiment, each of the movable blades 42 and 52 may be configured to stop at each of their corresponding stop positions by moving from the concealed position toward the cutting position. Such a control may thus encourage the user to clean each of the movable blades 42 and 52 (e.g., the cutting edges 421 and 521) from the lower portion toward the upper portion. Accordingly, such a control may reduce or prevent foreign matter removed from the movable blades 42 and 52 from adhering to the pivot 37.

In response to receiving a move instruction, the CPU 21 may control either one of the movable blades 42 and 52 to move to a respective next stop position. For example, the user may provide a move instruction to the CPU 21 after completing cleaning of the currently visible portion of the movable blade 42 or 52. As described above, the user may be allowed to provide a move instruction at any timing, thereby enabling the user to clean the cutting device 31 at an appropriate timing.

The CPU 21 may detect, based on the presence or absence of the detection signal outputted by the sensor 39, that the motor 27 is located at the initial position, i.e., may detect that the movable blades 42 and 52 are located at the respective concealed positions.

The CPU 21 may control the movable blade 42 or 52 to move to and stop at the next stop position based on the current position of the movable blade 42 or 52 detected by the sensor 39. Such a control may thus enable the movable blade 42 or 52 to move to and stop at the next stop position accurately.

In the illustrative embodiment, the tape 9 may include the adhesive layers 93 and 95. The tape 9 having such a structure may thus leave residues of adhesive layers 93 and 95 on the cutting device 31. Accumulation of adhesive residues on the cutting device 31 may cause degradation of the cutting performance of the cutting device 31, thereby causing a failure in cutting the tape 9. According to the illustrative embodiment, the printer 1 may enable the user to readily clean such adhesive residues left on the cutting device 31, thereby maintaining the cutting performance of the cutting device 31 sufficiently.

The tape 9 corresponds to a "medium". The space 10 corresponds to a "space". The motor 27 and the gear 32 correspond to a "moving mechanism". The CPU 21 that executes the processing of steps S23 and S33 of FIG. 10 corresponds to a "controller". The motor 26 and the drive shaft 62 correspond to an "advancing device". The front-rear direction corresponds to an "advance direction". The top-bottom direction corresponds to an "extending direction". The opening 11 corresponds to a "first opening". The opening 12 corresponds to a "second opening". The opening 13 corresponds to a "third opening". The CPU 21 that executes the processing of steps S21 and S31 of FIG. 10 corresponds to a "receiving unit". The sensor 39 corresponds to a "sensor". The printing base 91 corresponds to a "base". The adhesive layers 93 and 95 each correspond to an "adhesive layer".

While the disclosure has been described in detail with reference to the specific embodiment thereof, this is merely an example, and various changes, arrangements and modifications may be applied therein without departing from the spirit and scope of the disclosure. In the illustrative embodiment, the tape 9 includes a lamination of a printed portion of the printing base 91 and a portion of the adhesive tape 92. Nevertheless, the tape 9 is not limited to the specific example. In one example, the tape 9 might not necessarily include the adhesive tape 92. In such a case, the printing base 91 may correspond to the "medium". In another example, the printing base 91 may include a continuous strip base and an adhesive layer provided on the base. In such a case, a release sheet may be releasably adhered to the adhesive layer. In still another example, the medium may be, for example, a thermal printing sheet or a tube tape. The printer 1 may perform printing on such a medium.

In the illustrative embodiment, the sensor 39 may be a leaf switch. Nevertheless, in other embodiments, for example, the sensor 39 may be an optical sensor or the sensor 39 may be omitted. In the illustrative embodiment, the sensor 39 is configured to detect that the movable blades 42 and 52 are located at the respective concealed positions. Nevertheless, the configuration of the sensor 39 is not limited to the specific example. In one example, the sensor 39 may be configured to detect that one of the movable blades 42 and 52 is located at the cutting position. In another example, the sensor 39 may be configured to detect that one of the movable blades 42 and 52 is located at another reference position. In still another example, the sensor 39 may be configured to detect the current position of one of the movable blades 42 and 52 among a plurality of positions.

In the illustrative embodiment, the printer 1 may receive a move instruction by a user's operation through one or more of the operation buttons 5. Nevertheless, in other embodiments, for example, the printer 1 may be configured to receive a move instruction from an external device connected to the printer 1. The external device may be a general-purpose computer or a smartphone. In another example, the printer 1 may be configured to, in response to expiration of a predetermined time period since the movable blade 42 or 52 stops at a predetermined stop position, control the motor 27 to move the movable blade 42 or 52 to the next stop position. In still another example, the printer 1 may include a touch panel instead of the operation buttons 5.

In the illustrative embodiment, in the printer 1, the movable blade 42 or 52 may move to and stop at each of the stop positions in order of increasing distance from the concealed position. Nevertheless, in other embodiments, for example, the printer 1 may be configured to allow the user to select any stop position where the movable blade 42 or the movable blade 52 stops next. Such a configuration may thus enable the user to select any stop position to expose a desired portion of a desired blade (e.g., the movable blade 42 or 52) in the space 10 for cleaning, thereby enabling the user to clean the cutting device 31 efficiently.

In the illustrative embodiment, three stop positions may be provided for each of the movable blades 42 and 52. Nevertheless, in other embodiments, for example, two or less or four or more stop positions may be provided for each of the movable blades 42 and 52. A more upper portion of each of the movable blades 42 and 52 applies a smaller cutting force to the tape 9. Therefore, if foreign matter adheres to the upper portion of each of the movable blades 42 and 52, a tape cutting failure may occur more often than a case where foreign matter adheres to the lower portion of each of the movable blades 42 and 52. Accordingly, in other embodiments, for example, each of the movable blades 42 and 52 may be configured to stop at at least a respective single stop position (e.g., the third stop position) at which the upper portion of the movable blade 42 or 52 is visible to the user. Cleaning the upper portion of each of the movable blades 42 and 52 may ensure continued cutting performance of the cutting device 31. In the illustrative embodiment, the stop positions for the movable blade 42 are equal in number to the stop positions for the movable blade 52. Nevertheless, in other embodiments, for example, the stop positions for the movable blade 42 may be different in number to the stop positions for the movable blade 52

The configuration of the cutting device 31 is not limited to the specific example. In the illustrative embodiment, the cutting device 31 includes both the cutter 40 for full cutting and the cutter 50 for partial cutting. Nevertheless, the cutting device 31 may include either one of the cutters 40 and 50. If, however, the cutting device 31 includes only the cutter 50 for partial cutting, the printer 1 is not capable of performing full cutting. In such a case, the user may need to cut the tape 9 completely using scissors to separate a printed portion of the tape 9 from the remainder. The cutting device 31 may thus preferably include at least the cutter 40 for full cutting. In other embodiments, for example, the cutter 40 may include a stopper instead of the fixed blade 41. Such a configuration may enable the cutter 40 to perform both of full cutting and partial cutting without employing another cutter (e.g., the cutter 50). In such a case, for example, the stopper may include a first stopper and a second stopper. The first stopper may have a flat surface. The second stopper may have an uneven surface having recesses. The stopper may be configured to change its portion subjected to facing the movable blade 42 between the first stopper and the second stopper. When the first stopper faces the movable blade 42, the movable blade 42 contacts the first stopper with not gap being left between the cutting edge 421 and the surface of the first stopper, thereby cutting the tape 9 completely (e.g., full cutting). When the second stopper faces the movable blade 42, the movable blade 42 contacts the second stopper with a predetermined gap being left between the cutting edge 421 and the surface of the second stopper, thereby cutting the tape 9 incompletely (e.g., partial cutting).

In the illustrative embodiment, the movable blade 42 may be supported by the pivot 37 so as to be pivotable relative to the fixed blade 41. Nevertheless, in other embodiments, for example, the movable blade 42 may be supported by a guide such as a rail so as to be linearly movable relatively toward and away from the fixed blade 41. In such a case, it may be acceptable to provide a single stop position for cleaning the entire portion of the cutting edge 421 of the movable blade 42 in the space 10. In other embodiments, for example, the movable blade 42 might not necessarily be movable relatively toward and away from the fixed blade 41. In one example, the movable blade 42 may have a disc shape and include an axis on its center. In such a case, the movable blade 42 may be a rotary cutter that may cut the tape 9 in cooperation with the fixed blade 41 by rotating about its axis. In another example, the fixed blade 41 and the movable blade 42 may be disposed such that their cutting edges 411 and 421 extend parallel to each other and are contactable to each other. In such a case, the movable blade 42 may be a sliding cutter. The movable blade 42 may be configured, for example, such that while the movable blade 42 moves linearly relative to the fixed blade 41, the cutting edge 421 of the movable blade 42 passes between one end and the other of the cutting edge 411 of the fixed blade 41 and slides against the cutting edge 411 of the fixed blade 41 to cut the tape 9.

In the illustrative embodiment, when the cover 3 is located at the closed position, the cover 3 may cover the opening 12 and the opening 13 and uncover the opening 11. Nevertheless, in other embodiments, for example, when the cover 3 is located at the closed position, the cover 3 may cover the opening 11 and uncover either or both of the openings 12 and 13. In other embodiments, for example, the printer 1 might not necessarily include the cover 3. Omission of the cover 3 in the printer 1 may reduce the number of user's steps to be performed in cleaning. In other words, opening the cover 3 may be omitted.

In the illustrative embodiment, the space 10 may include a portion of the area H. Nevertheless, in other embodiments, for example, the space 10 might not necessarily include any portion of the area H. That is, the casing 2 may has another space for cleaning the cutting device 31 at a position different from the area H. For example, the upper portion of the casing 2 may have another cavity (hereinafter, referred to as a cavity for cleaning) opposite to the cavity 15 with respect to the movable blade 42. The cavity for cleaning defines a portion of the space for cleaning. In such a case, the stop positions might not necessarily be provided on their respective moving routes between the cutting position and the concealed position for each of the movable blades 42 and 52. For example, each of the movable blades 42 and 52 may be configured to pivot about the pivot 37 counterclockwise when viewed from the front, from the concealed position to the cutting position, and pivot about the pivot 37 clockwise when viewed from the front, to move to one of the stop positions (e.g., each of the movable blades 42 and 52 may be located at the space for cleaning). The casing 2 may have the cavity for cleaning at a portion other than the portion having the cavity 15 (e.g., other than the upper portion of the casing 2).

In the illustrative embodiment, a common motor (e.g., the motor 27) is provided for moving each of the movable blades 42 and 52. Nevertheless, in other embodiments, for example, separate motors may be provided for moving the respective movable blades 42 and 52.

What is claimed is:

1. A printer for performing printing on a medium, the printer comprising:

a casing defining an opening in a portion thereof, the opening communicating with an area outside the casing;

a cutter disposed within the casing and configured to cut at least a portion of the medium, wherein the cutter includes a movable blade;

a moving mechanism configured to move the movable blade; and a processor; and one or more non-transitory computer readable storage media storing instructions that, when executed by the processor, cause the printer to:

control the moving mechanism to move the movable blade to a first position, a second position, and a third position, and to stop the movable blade at the second position, wherein the second position is between the first position and the third position, and wherein, at the second position, a portion of the movable blade is exposed through the opening to the area outside the casing.

2. The printer according to claim 1, further comprising an advancing device configured to move the medium in an advance direction to a medium advance area, wherein the cutter extends in an extending direction that intersects with the advance direction, wherein, at the first position, the movable blade is positioned out of the medium advance area or a first portion of the cutter is positioned in the medium advance area, wherein, at the second position, a second portion of the movable blade is positioned in the medium advance area, wherein, at the third position, a third portion of the movable blade is positioned in the medium advance area, wherein the third portion is greater than the second portion, and the second portion is greater than the first portion, wherein the opening includes a portion of the medium advance area, and wherein the opening is located downstream from the cutter in the advance direction.

3. The printer according to claim 2, wherein the casing further defines a second opening located upstream from the cutter in the advance direction.

4. The printer according to claim 3, wherein the casing further defines a third opening located above the cutter in the extending direction.

5. The printer according to claim 4, further comprising a cover configured to move between a closed position at which the cover is closed with respect to the casing and an open position at which the cover is opened with respect to the casing, wherein, when the cover is located at the closed position, the cover covers the second opening and the third opening.

6. The printer according to claim 2, wherein the cutter includes at least one of a first cutter configured to fully cut the medium and a second cutter configured to partially cut the medium, wherein the first cutter includes:

a fixed blade fixed in place; and a first movable blade configured to move toward and away from the fixed blade, and wherein the movable blade includes the first movable blade, wherein the second cutter includes:

a stopper fixed in place; and a second movable blade configured to move toward and away from the stopper, and wherein the movable blade includes the second movable blade.

7. The printer according to claim 6, wherein the moving mechanism is further configured to move the first movable blade of the first cutter between the first position and the third position, wherein the first movable blade is positioned apart from the fixed blade when in the first position, wherein the first movable blade is positioned to overlap with the fixed blade when in the third position, and wherein the second position is defined on a route along which the first movable blade moves between the first position and the third position.

8. The printer according to claim 7, wherein the moving mechanism is further configured to move the second movable blade of the second cutter between the first position and the third position, wherein the second movable blade is positioned apart from the stopper when in the first position, wherein the second movable blade is positioned proximate to the stopper with a predetermined gap therebetween when in the third position, and wherein the second position is defined on a route along which the second movable blade moves between the first position and the third position.

9. The printer according to claim 8, wherein the instructions, when executed by the processor, further cause the printer to:

control the moving mechanism to move the movable blade to stop at a plurality of stop positions between the first position and the third position, and wherein the plurality of stop positions includes the second position.

10. The printer according to claim 9, wherein the instructions, when executed by the processor, further cause the printer to:

where the cutter includes the first cutter only, control the moving mechanism to stop the first movable blade of the first cutter at each of the plurality of stop positions in order of increasing distance from the first position, and where the cutter includes the first cutter and the second cutter, control the moving mechanism to stop at least one of the first movable blade of the first cutter and the second movable blade of the second cutter at each of the plurality of stop positions in order of increasing distance from the first position.

11. The printer according to claim 1, further comprising a receiving unit configured to receive a move instruction for moving the movable blade, wherein the instructions, when executed by the processor, cause the printer to:

in response to the receiving unit receiving the move instruction, control the moving mechanism to move the movable blade to stop at one of: the first position, the second position, and the third position.

12. The printer according to claim 11, further comprising at least one operation button, wherein the receiving unit is configured to receive the move instruction based on an operation of the at least one operation button.

13. The printer according to claim 1, further comprising a sensor configured to detect a position of the movable blade, wherein the instructions, when executed by the processor, further cause the printer to:

based on the position of the movable blade detected by the sensor, control the moving mechanism to stop the movable blade at one of: the first position, the second position, and the third position.

14. The printer according to claim 1, wherein the medium includes a continuous strip of a base and an adhesive layer provided on the base.

15. The printer according to claim 1, wherein the instructions, when executed by the processor, further cause the printer to:

control the moving mechanism to move the movable blade to stop at a plurality of stop positions between the first position and the third position, and wherein the plurality of stop positions includes the second position.

* * * * *